US007697854B2

(12) United States Patent
Itoyama et al.

(10) Patent No.: US 7,697,854 B2
(45) Date of Patent: Apr. 13, 2010

(54) IMAGE FORMING APPARATUS WITH VARIABLE PROCESS SPEED

(75) Inventors: Motoyuki Itoyama, Kizugawa (JP); Syouichi Fujita, Kashiba (JP); Mitsuhiro Murata, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 119 days.

(21) Appl. No.: 12/041,702

(22) Filed: Mar. 4, 2008

(65) Prior Publication Data

US 2008/0219684 A1 Sep. 11, 2008

(30) Foreign Application Priority Data

Mar. 6, 2007 (JP) ..... 2007-056392

(51) Int. Cl.
*G03G 15/00* (2006.01)
*G03G 15/08* (2006.01)

(52) U.S. Cl. ..... 399/38; 399/27; 399/30; 399/44; 399/49; 399/82

(58) Field of Classification Search ..... 399/30, 399/82, 38, 44, 49, 58, 62; 347/19; 358/406, 358/504

See application file for complete search history.

(56) References Cited

U.S. PATENT DOCUMENTS

2007/0036566 A1* 2/2007 Takeuchi et al. ..... 399/27
2007/0223946 A1* 9/2007 Watanabe ..... 399/27
2008/0124108 A1* 5/2008 Tokuyama et al. ..... 399/62

FOREIGN PATENT DOCUMENTS

| | | | |
|---|---|---|---|
| JP | 2002-169369 | | 6/2002 |
| JP | 2003-280355 A | * | 10/2003 |
| JP | 2004-053744 | | 2/2004 |
| JP | 2004-361511 | | 12/2004 |
| JP | 2005-172868 | | 6/2005 |

* cited by examiner

*Primary Examiner*—Sophia S Chen
(74) *Attorney, Agent, or Firm*—Renner, Otto, Boisselle & Sklar, LLP

(57) ABSTRACT

An image forming apparatus is provided which is capable of forming higher-quality images by detecting a toner concentration with higher accuracy to attain appropriate toner supply and image density. A value obtained by adding a correction value based on a temperature, humidity, a print coverage, or the like to a developer concentration adjustment value is set as a control voltage value Vc which is to be inputted to a toner concentration sensor, and an output value of the toner concentration sensor is detected for each of process speeds. A difference between the output value detected and a value at reference process speed is calculated and based on the difference, a correction value is further calculated. Such another calculation of the correction value with use of the output value detected allows for highly accurate correction.

10 Claims, 4 Drawing Sheets

IMAGE FORMING APPARATUS WITH VARIABLE PROCESS SPEED

CROSS-REFERENCE TO RELATED APPLICATION

This application claims priority to Japanese Patent Application No. 2007-056392, which was filed on Mar. 6, 2007, the contents of which are incorporated herein by reference in its entirety.

BACKGROUND OF THE INVENTION

1. Field of the Invention

The present invention relates to an image forming apparatus for forming images in an electrophotographic process.

2. Description of the Related Art

In an electrophotographic image forming apparatus, high-quality images can be formed in a short time through simple operations, and moreover a maintenance of the apparatus is easy. The electrophotographic image forming apparatus has been therefore widely used for a copier, a printer, or a facsimile apparatus, for example. The image forming apparatus includes, for example, a photoreceptor, a charging device, an exposing device, a developing device, a transferring device, a fixing device, and a cleaning device. The photoreceptor is a roller-like member which has a surface provided with a photosensitive layer. The charging device is impressed with voltage to charge the surface of the photoreceptor with predetermined potential. The exposing device forms an electrostatic latent image on the charged surface of the photoreceptor by emitting thereto signal light which corresponds to image information. The developing device develops a toner image by supplying a toner to the electrostatic latent image on the surface of the photoreceptor. The transferring device transfers onto a recording medium the toner image formed on the surface of the photoreceptor drum. The fixing device fixes the toner image to the recording medium. As a result, an image is formed on the recording medium. The cleaning device is a blade-like member which is disposed in contact with the surface of the photoreceptor, being used to remove the toner which remains on the surface of the photoreceptor after the toner image has been transferred therefrom.

The developing device used herein includes a developing roller, a developer tank, and a toner concentration sensor. The developing roller supplies the toner to the electrostatic latent image on the surface of the photoreceptor to form the toner image thereon. The developer tank stores therein two-component developer containing the toner to supply the two-component developer to the developing roller. The toner concentration sensor detects the concentration of the toner in the developer tank. In accordance with a result detected by the toner concentration sensor, toner supply into the developer tank is controlled. The toner concentration sensor normally outputs a detection result in the form of voltage. The output voltage of the toner concentration sensor is, however, susceptible to detection sensitivity of the toner concentration sensor itself, an environment (a temperature, humidity, and the cumulative number of prints) in which the two-component developer is used, and the like parameter. For example, the toner concentration sensor exhibits different detection sensitivities depending on a temperature, humidity, or the like parameter. The detection sensitivity of the toner concentration sensor changes depending also on an image printing speed, the number of printed images, etc. in the image forming apparatus. Further, in a color image forming apparatus, the toner concentration sensor outputs different detection results depending even on a toner color. This may cause a failure to supply an appropriate amount of toner to the developer tank, in consequence whereof a lower-density image, a partially scraped image, or the like image may be formed.

Furthermore, in an image forming apparatus having a plurality of process speeds (print speeds), it is necessary to modify an inputted set value in order to adjust the detection result of the toner concentration sensor for the respective process speeds.

For example, in an image forming apparatus disclosed in Japanese Unexamined Patent Publication JP-A 2002-169369, the concentration of the toner in the developer tank is detected upon changing an image resolution and a process speed, and according to the detected toner concentration and the process speed, a threshold value for voltage outputted by a toner concentration sensor is modified.

Further, in an image forming apparatus disclosed in Japanese Unexamined Patent Publication JP-A 2004-361511, when an image forming process speed is modified by a speed-modifying section, a condition-setting section sets a reference value as a set value of image forming condition in an image forming mode serving as a reference while setting a corrected value that is obtained by adjusting the reference value with use of a correction coefficient, as a set value of image forming condition in another image forming mode. After the image forming process speed has been modified by the speed-modifying section, the correction coefficient is revised by a revising section. The correction coefficient thus revised by the revising section is stored in a memory section to be used later on.

According to the related art, a set value of the toner concentration sensor for each process speed is measured in an initial stage before an image formation is carried out, whereby a coefficient relative to a reference process speed is determined for a process speed other than a reference process speed. After the start of the image formation, the toner concentration is measured only for the reference process speed to modify the set value while, for the process speed other than the reference process speed, the coefficient determined in the initial stage is merely used to modify the set value.

Since the coefficient determined in the initial stage is used even after the start of the image formation, a temporal change is not sufficiently taken into consideration, which may result in a failure to appropriately set the set value for another process speed. The failure to appropriately set the set value of the toner concentration sensor leads to a failure to accurately detect the concentration of the toner in the developer tank, which failure affects the toner supply, image density, etc. to cause a decrease in quality of images to be outputted.

SUMMARY OF THE INVENTION

An object of the invention is to provide an image forming apparatus which is capable of realizing an appropriate toner supply and toner concentration by achieving higher accuracy of toner concentration detection and capable of forming higher quality images.

The invention provides an image forming apparatus comprising:

an image forming section for forming an image by printing a toner image on a recording medium, the image forming section including a photoreceptor having a photosensitive layer for forming an electrostatic latent image, and a developing device having a developing roller for forming a toner image by supplying a toner to the electrostatic latent image on the surface of the photoreceptor and a developer tank for storing two-component developer containing a toner;

a print speed switching section for switching image printing speeds of the image forming section;

a toner concentration detecting section for detecting a concentration of the toner in the developer tank and outputting a detection result, an output value of the detection result being modified according to a control value inputted to the toner concentration detecting section;

a memory portion for storing a correction value for the control value, which correction value is determined by an association between image printing speed and another predetermined correction parameter;

a correcting section for correcting the control value based on image printing speed and another predetermined correction parameter;

a toner concentration calculating section for calculating the concentration of the toner in the developer tank based on the detection result outputted by the toner concentration detecting section; and a detection result correcting section for, during a no-image forming period, retrieving for each image printing speed a detection result outputted by the toner concentration detecting section to which the corrected control value has been inputted, and modifying the corrected control value according to the detection result retrieved.

According to the invention, the toner concentration detecting section outputs the concentration of the toner in the developer tank and then outputs the detection result, and according to the control value inputted to the toner concentration detecting section, the output value of the detection result can be modified.

The control value is corrected by the correcting section. During the no-image forming period, the detection result correcting section retrieves for each image printing speed the detection result outputted by the toner concentration detecting section to which the corrected control value has been inputted, and according to the retrieved detection result, the detection result correcting section then modifies the corrected control value.

As a result, the detected result outputted by the toner concentration detecting section becomes more accurate, which achieves appropriate toner supply and image density, thus allowing for higher-quality images to be formed.

Further, in the invention, it is preferable that the no-image forming period is a period of start-up of the apparatus or a period after images have been formed on a predetermined number of sheets.

According to the invention, the corrected control value is modified when the apparatus is started up or after images have been formed on a predetermined number of sheets, so that an operation of the image forming section is not interfered.

Further, in the invention, it is preferable that the developing device stores two-component developer containing a color toner.

According to the invention, the developing device stores the two-component developer containing the color toner. Upon forming a color image, a print speed needs to be slow in consideration of a color combination and a hue, which situation demands high accuracy in controlling the toner concentration. The correction of the control value performed in the invention therefore produces more prominent effect thereof in the case of forming a color image.

Further, in the invention, it is preferable that the detection result correcting section determines a reference print speed; obtains a difference between a detection result at the reference print speed and a detection result at a print speed other than the reference print speed; and modifies the corrected control value according to a value of the difference obtained.

According to the invention, the detection result correcting section determines the reference print speed; obtains the difference between the detection result at the reference print speed and a detection result at a print speed other than the reference print speed; and modifies the corrected control value according to the value of the difference obtained. The corrected control value can be therefore modified relative to the reference print speed.

Further, in the invention, it is preferable that the image forming apparatus further comprises a temperature detecting section for detecting a temperature of an environment in the apparatus, wherein the memory portion stores, as another correction parameter, the temperature detected by the temperature detecting section, and a correction value determined according to the temperature.

According to the invention, the temperature detected by the temperature detecting section is stored as another correction parameter, and the correction value determined according to the temperature is also stored. The corrected control value can be thus modified according to the temperature of the environment in the apparatus.

Further, in the invention, it is preferable that the image forming apparatus further comprises a humidity detecting section for detecting humidity of an environment in the apparatus, wherein the memory portion stores, as another correction parameter, the humidity detected by the humidity detecting section, and a correction value determined according to the humidity.

According to the invention, the humidity detected by the humidity detecting section is stored as another correction parameter, and the correction value determined according to the humidity is also stored. The corrected control value can be thus modified according to the humidity of the environment in the apparatus.

Further, in the invention, it is preferable that the image forming apparatus further comprises a measuring section for measuring a temporal change of the two-component developer, wherein the memory portion stores, as another correction parameter, a measurement value and a correction value determined according to the measurement value.

According to the invention, the measurement value indicative of the temporal change of the two-component developer is stored as another correction parameter, and the correction value determined according to the measurement value is also stored. The corrected control value can be thus modified according to the temporal change of the developer.

Further, in the invention, it is preferable that the image forming apparatus further comprises a print coverage calculating section for calculating a print coverage of an image printed on a recording medium, wherein the memory portion stores, as another correction parameter, the print coverage, and a correction value determined according to the print coverage.

According to the invention, the print coverage of the image printed on the recording medium is stored as another correction parameter, and the correction value determined according to the print coverage is also stored. The corrected control value can be thus modified according to the print coverage.

Further, in the invention, it is preferable that the image forming apparatus further comprises a process control section for adjusting image density and a developing condition according to density of a toner patch, wherein the memory portion stores, as another correction parameter, the density of the toner patch, and a correction value determined according to the density of the toner patch.

According to the invention, the toner patch density is stored as another correction parameter, and the correction value determined according to the toner patch density is also stored. The corrected control value can be thus modified according to the toner patch density.

Further, in the invention, it is preferable that the detection result correcting section modifies the corrected control value during operation of the process control section.

According to the invention, the detection result correcting section modifies the corrected control value during operation of the process control section. The detection result obtained by the process control section can be thus used, with the result that the control value can be swiftly modified.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
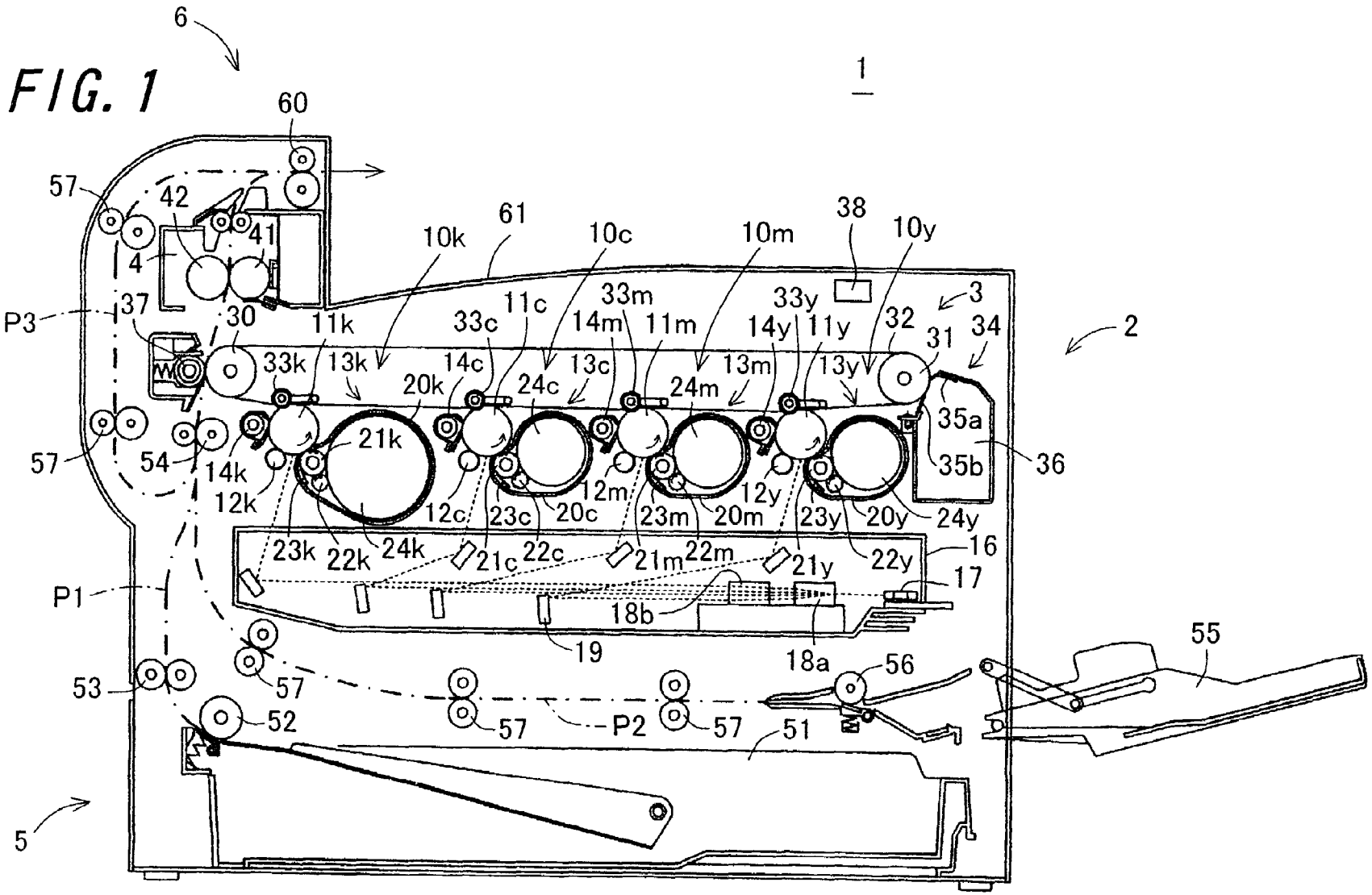
FIG. 1 is a sectional view schematically showing a configuration of an image forming apparatus according to one embodiment of the invention.

Now referring to the drawings, preferred embodiments of the invention are described below.

Figure 2:
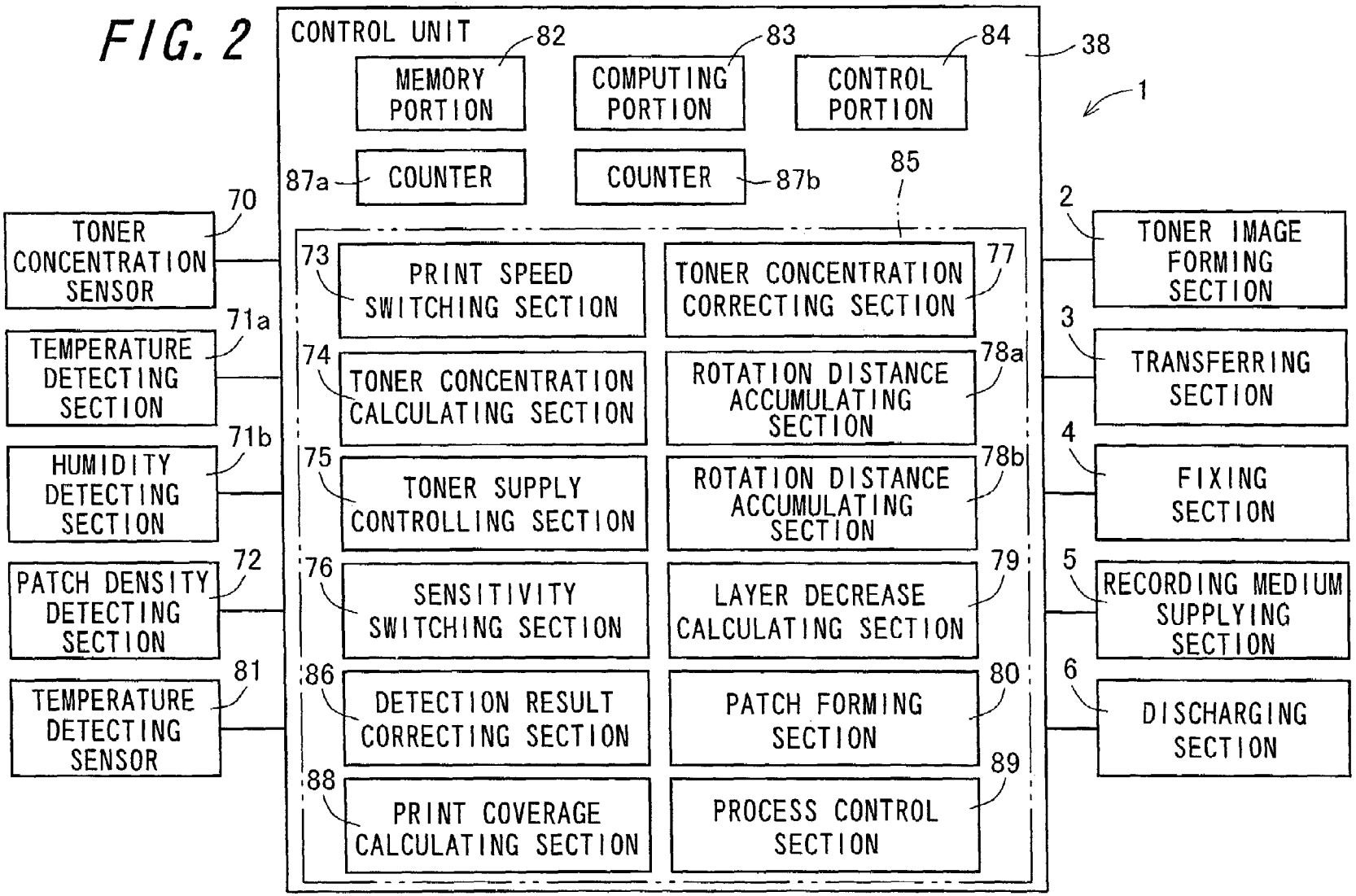
FIG. 2 is a block diagram schematically showing an electrical configuration of the image forming apparatus according to one embedment of the invention.

FIG. 1 is a sectional view schematically showing a configuration of an image forming apparatus 1 according to one embodiment of the invention. FIG. 2 is a block diagram schematically showing an electrical configuration of the image forming apparatus 1 according to one embedment of the invention. The image forming apparatus 1 is a multifunctional system which combines a printer function and a facsimile function. In the image forming apparatus 1, according to image information transmitted thereto, a full-color or black-and-white image is formed on a recording medium. To be specific, two print modes, i.e., a printer mode and a facsimile mode are available in the image forming apparatus 1, either of which print modes is selected by a control portion 84 in response to an operation input given by a operating portion (not shown) and a print job given by a personal computer, a mobile computer, an information record storage medium, or an external equipment having a memory unit.

Further, the image forming apparatus 1 has three print modes, i.e., a monochrome image print mode, a color image print mode, and a heavy paper print mode. In the monochrome image print mode, monochrome (unicolor) images are printed at monochrome image print speed. The monochrome image print speed is the highest among print speeds in the three print modes. In the color image print mode, a color image is printed at color image print speed. The color image print speed is higher than the print speed in the heavy paper print mode. In the heavy paper print mode, images are printed at heavy paper print speed. The heavy paper is a recording sheet whose basis weight is 106 g/m$^2$ to 300 g/m$^2$. The heavy paper print mode can be set by manual input through an operation panel (not shown) which is disposed above the image forming apparatus 1 as viewed in a vertical direction. In the present embodiment, the process speed is 255 mm/sec and the print speed is 45 sheets/min in the monochrome image forming mode (high-speed print mode); the process speed is 167 mm/sec and the print speed is 35 sheets/min in the color image forming mode (middle-speed print mode); and the process speed is 83.5 mm/sec and the print speed is 17.5 sheets/min in the heavy paper print mode (low-speed print mode). Hereinafter, the notation "high" may be used for the monochrome image forming process; the notation "middle" may be used for the color image forming process; and the notation "low" may be used for the heavy paper print process.

The image forming apparatus 1 includes a toner image forming section 2, a transferring section 3, a fixing section 4, a recording medium supplying section 5, a discharging section 6, and a control unit 38. Among these components, the toner image forming section 2, the transferring section 3, the fixing section 4, the recording medium supplying section 5, and the discharging section 6 correspond to an image forming section. In accordance with image information of respective colors of black (k), cyan (c), magenta (in), and yellow (y) which are contained in color image information, there are provided respectively four sets of the components constituting the toner image forming section 2 and some parts of the components contained in the transferring section 3. The four sets of respective components provided for the respective colors are distinguished herein by giving alphabets indicating the respective colors to the end of the reference numerals (for example, 10*k*, 10*c*, 10*m* and 10*y* in FIG. 1), and in the case where the sets are collectively referred to, only the reference numerals are shown.

The toner image forming section 2 includes a photoreceptor drum 11, a charging section 12, an exposure unit 16, a developing device 13, and a cleaning unit 14. The charging section 12, the developing device 13, and the cleaning unit 14 are disposed around the photoreceptor drum 11 in the order just stated from an upstream side in a direction where the photoreceptor drum 11 rotates.

The photoreceptor drum 11 is a roller-like member which is rotatably supported around an axis thereof by a driving mechanism (not shown) and has a photosensitive layer for an electrostatic latent image and thus a toner image to be formed on a surface of the photoreceptor drum 11. One example of the roller-like member available for the photoreceptor drum 11 includes a conductive substrate (not shown) and a photosensitive layer (not shown) formed on a surface of the conductive substrate. The conductive substrates having various shapes such as a cylindrical shape, a circular columnar shape, and a sheet shape may be used, and among these conductive substrates, the conductive substrate having the cylindrical shape is preferred. As the photosensitive layer, an organic photosensitive layer, an inorganic photosensitive layer, or the like layer may be used. The organic photosensitive layer includes, for example: a laminate composed of a charge generating layer which is a resin layer containing a charge generating substance, and a charge transporting layer which is a resin layer containing a charge transporting substance; and a resin layer which contains a charge generating substance and a charge transporting substance. The inorganic photosensitive layer includes a film which contains one or two or more substances selected from zinc oxide, selenium, and amorphous silicone. Between the conductive base and the photosensitive layer may be interposed an undercoat layer, and a surface of the photosensitive layer may be provided with a surface layer (a protective layer) for protecting the photosensitive layer mainly.

The charging section 12 is a roller-like member which is disposed in pressure-contact with the photoreceptor drum 11. A power source (not shown) is connected to the charging section 12 to thereby apply a voltage to the charging section 12. The charging section 12 to which the voltage is applied, charges the surface of the photoreceptor drum 11 with predetermined polarity and potential. Although a roller-type charging section is employed in the present embodiment, the charging section 12 is not limited to the roller-type and for example, a contact-type charger may be used such as a charging brush-type charger, a charger-type charger, a saw-tooth type charger, an ion generator, or a magnetic brush.

As the exposure unit 16, a laser scanning unit is used which is composed of a light emitting section (not shown), a polygon mirror 17, a first fθ lens 18*a*, and a second fθ lens 18*b*, and a plurality of reflecting mirrors 19. The exposure unit 16 emits signal light to the charged surface of the photoreceptor drum 11, thereby forming electrostatic latent images corresponding to image information. The light emitting section emits the signal light corresponding to the image information. As the light emitting section, a light source can be used such as a semiconductor laser or an LED array. The light source may be used in combination with a liquid crystal shutter. The polygon mirror 17 rotates at constant angular velocity to thereby deflect the signal light emitted by the light emitting section. The first fθ lens 18*a* and the second fθ lens 18*b* divide the signal light deflected by the polygon mirror 17 into signal light beams which respectively correspond to image information of yellow, magenta, cyan, and black so that the respective signal light beams are directed to the reflecting mirrors 19 for corresponding colors. As being reflected by the reflecting mirror 19, the signal light beams of respective colors coming by way of the first fθ lens 18*a* and the second fθ lens 18*b* are directed to the photoreceptor drums 11. As a result, electrostatic latent images corresponding to respective colors are formed on the photoreceptor drums 11*y*, 11*m*, 11*c*, and 11*k*.

The developing device 13 includes a developer tank 20, a developing roller 21, a supply roller 22, a layer thickness-regulating member 23, a toner cartridge 24, and a toner concentration sensor 70 which serves as a toner concentration detecting section.

The developer tank 20 is a container-like member which is disposed so as to face the surface of the photoreceptor drum 11, and in an internal space of the developer tank 20, developer is contained as well as the developing roller 21, the supply roller 22, the layer thickness-regulating member 23, and the toner cartridge 24. The developer usable herein is one-component developer which contains a toner only, or two-component developer which contains a toner and a carrier. The developer tank 20 has an opening in a side face thereof opposed to the photoreceptor drum 11. The opening is thus located between the surface of photoreceptor drum 11 and the developing roller 21 which face each other.

The developing roller 21 is a roller-like member which is rotatably supported by the developer tank 20 and rotated by a driving mechanism (not shown) about an axis of the developing roller 21 itself. The developing roller 21 is disposed so that the axis thereof becomes parallel to an axis of the photoreceptor drum 11. The developing roller 21 bears on a surface thereof a developer layer and supplies the toner to the electrostatic latent image on the surface of the photoreceptor drum 11 in a pressure-contact area (development nip area) between the developing roller 21 and the photoreceptor drum 11, thereby developing the electrostatic latent image into a toner image. To the developing roller 21 is connected a power source (not shown) and upon supplying the toner, the power source serves to apply to the surface of the developing roller 21 a potential whose polarity is opposite to a polarity of potential of the charged toner. The potential causes a development bias voltage (hereinafter referred to simply as "development bias"). This allows the toner on the surface of the developing roller 21 to be smoothly supplied to the electrostatic latent image. Furthermore, an amount of the toner being supplied to the electrostatic latent image (a toner-attached amount) can be controlled by changing a value of the development bias.

The supply roller 22 is a roller-like member which is rotatably supported by the developer tank 20 and rotated by a driving mechanism (not shown) about an axis of the supply roller 22 itself. Further, the supply roller 22 is disposed so as to face the photoreceptor drum 11 in a manner that the developing roller 21 is located between the supply roller 22 and the photoreceptor drum 11. The supply roller 22 rotates to thereby supply the developer contained in the developer tank 20 to the surface of the developing roller 21, and mixes the developer contained in the developer tank 20 with the toner discharged from the later-described toner cartridge 24. The layer thickness-regulating member 23 is a platy member which is disposed so as to have one end supported by the developer tank 20 and the other end in contact with the surface of the developing roller 21. The layer thickness-regulating member 23 regulates a thickness of the developer layer on the surface of the developing roller 21.

The toner cartridge 24 is a cylindrical container member which is detachably disposed in a main body of the image forming apparatus 1, and in an internal space of the toner cartridge 24, the toner is stored. The toner cartridge 24 is disposed so as to be rotatable about an axis thereof by a driving mechanism provided inside the image forming apparatus 1. A side face of the toner cartridge 24 as viewed in a direction of an axis thereof is provided with a toner discharge port (not shown) which extends along the direction of the axis. The rotation of the toner cartridge 24 causes the toner to be discharged from the toner discharge port into the developer tank 20. Almost an equal amount of the toner is discharged from the toner cartridge 24 by every one rotation of the toner cartridge 24. Accordingly, the control on the number of rotations of the toner cartridge 24 enables the control on the amount of toner being supplied into the developer tank 20.

On a bottom surface of the developer tank, for example, the toner concentration sensor 70 is mounted below the supply roller 22 as viewed in the vertical direction so that a sensor face of the toner concentration sensor is exposed inside the developer tank 20. The toner concentration sensor 70 is electrically connected to the control unit 38.

The toner concentration sensor 70 is disposed for each of the toner image forming sections 2*y*, 2*m*, 2*c*, and 2*k*. The control unit 38 controls the rotation of the toner cartridges 24*y*, 24*m*, 24*c*, and 24*k* in accordance with the detection result of the toner concentration sensor 70, thereby supplying the toner into the developer tanks 20*y*, 20*m*, 20*c*, and 20*k*. For the toner concentration sensor 70, a commonly-used toner concentration sensor can be used such as a transmitted light detecting sensor, a reflected light detecting sensor, or a permeability detecting sensor. Among these sensors, the transmitted light detecting sensor is preferred.

The permeability detecting sensor has four terminals, i.e., a GND (ground) terminal; a drive voltage (24V) input terminal for driving the sensor; an output terminal whose output voltage is represented by Vout (zero to 5 V output, and the output voltage level is represented by an 8-bit converted value); and a control voltage input terminal to which is inputted a control voltage represented by Vc (zero to 10 V input, and the input voltage level is represented by an 8-bit converted value). The permeability detecting sensor is a sensor which is impressed with the control voltage to output, as an output voltage value, the result of detected toner concentration. Since the sensitivity of the permeability detecting sensor around a median of the output voltage is basically high, such a control voltage is applied to the permeability detecting sensor as to obtain an output voltage (for example, 2.5 V) around the median when the permeability detecting sensor is used.

The output voltage Vout has a tendency to change depending on the process speed. For example, when the output voltage Vout at middle is 2.5 V, the output voltage Vout at high is 2.2 V and the output voltage at low is 2.8 V. Moreover, the output voltage Vout which changes depending on the concentration of the toner in the developer tank 20, can be shifted by changing the input voltage value of the control voltage Vc.

It therefore turns out that, in order to set the output voltages Vout at the three process speeds to the same level, it is only necessary to modify the control voltages Vc for respective process speeds.

The application of the control voltage to the permeability detecting sensor is controlled by the control unit 38. The permeability detecting sensor of the above-described type is commercially available such as TS-L, TS-A, and TS-K (all of which are trade names and manufactured by TDK Corporation). Note that the control voltage of the toner concentration sensor 70 can be different for each process speed. To be more specific, the control is carried out such that switching of the process speed causes the control voltage to change.

In the case where the two-component developer containing a color toner is used in the developing device 13, the correction of control voltage produces more prominent effect thereof. This is because the toner concentration is required to be controlled with high accuracy in the case of forming a color image, where the print speed needs to be slow in consideration of a color combination and a hue.

The cleaning unit 14 cleans the surface of the photoreceptor drum 11 by removing the toner which remains on the surface of the photoreceptor drum 11 after the toner image has been transferred onto the later-described intermediate transfer belt 32. The cleaning unit 14 includes, for example, a cleaning blade, a first waste toner reservoir, and a waste toner-conveying roller. The cleaning blade is a platy member which has one end in contact with the surface of the photoreceptor drum 11 and the other end supported by the first waste toner reservoir. The cleaning blade scrapes off the toner, etc. from the surface of the photoreceptor drum 11. The first waste toner reservoir is a container-like member, in an internal space whereof the cleaning blade and the toner-conveying roller are contained and furthermore, the toner, etc. scraped off by the cleaning blade accumulates for the moment. The waste toner-conveying roller is a roller-like member which is rotatably supported by the toner reservoir and capable of rotating about an axis of the waste toner-conveying roller by a driving mechanism (not shown). The rotation of the waste toner-conveying roller causes the toner contained in the waste toner reservoir to be conveyed through a toner-conveying pipe (not shown) which is connected to the first waste toner reservoir, to a waste toner tank (not shown) where the toner then accumulates. The waste toner tank which is filled up with the toner is replaced by a new waste toner tank.

Further, in the embodiment, a temperature detecting section 71*a* and a humidity detecting section 71*b* are disposed in the vicinity of the toner image forming section 2, preferably the developing device 13, so as to detect a temperature and humidity around the developing device 13. The temperature detecting section 71*a* and the humidity detecting section 71*b* are electrically connected to the control unit 38, and detection results of the temperature detecting section and the humidity detecting section are inputted to the control unit 38. For the temperature detecting section 71*a* and the humidity detecting section 71*b*, commonly-used sensors may be used including a temperature and humidity sensor. In the embodiment, a button-type temperature and humidity recorder: Hygrochron (trade name) manufactured by KN Laboratories, Inc.). In the control unit 38, the control voltage Vc is adjusted according to the detection result of the temperature detecting section 71*a* and the humidity detecting section 71*b*.

Further, in the embodiment, a patch density detecting section 72 is disposed between a position downstream of the developing device 13 and a position upstream of an intermediate transfer nip area as viewed in the direction where the photoreceptor drum 11 rotates. The patch density detecting section 72 detects toner concentration (patch density) of a toner patch which has been formed on the surface of the photoreceptor drum 11 by the later-described patch forming section 80. The patch density detecting section 72 is electrically connected to the control unit 38 of the image forming apparatus 1. A detection result of the patch density detecting section 72 is thus outputted to the control unit 38. In accordance with the detection result of the patch density detecting section 72, the control unit controls the toner concentration of the toner image which is formed by the toner image forming section 2. The control is carried out, for example, by changing the development bias voltage. The toner concentration can be controlled also by adjusting a charge potential of the photoreceptor drum 11, an exposure potential given by the exposure unit 16, and the like factor. For the patch density detecting section 72, a commonly-used toner concentration detecting sensor can be used including a transmitted light detecting sensor, a reflected light detecting sensor, or a permeability detecting sensor, as in the case of the toner concentration sensor 70.

In the toner image forming section 2, the exposure unit 16 emits the signal light corresponding to the image information to the surface of photoreceptor drum 11 uniformly charged by the charging section 12, whereby the electrostatic latent image is formed; the developing device 13 supplies the toner to the electrostatic latent image, whereby the toner image is formed; the toner image is transferred to the intermediate transfer belt 32; and the cleaning unit 14 removes the toner which remains on the surface of the photoreceptor drum 11. A series of toner image forming operations just described is repeatedly carried out.

The transferring section 3 includes a driving roller 30, a driven roller 31, the intermediate transfer belt 32, intermediate transfer rollers 33(*y, m, c, k*), a transfer belt cleaning unit 34, and a transfer roller 37. The transferring section 3 is disposed above the photoreceptor drum 11.

The driving roller 30 is a roller-like member which is rotatably supported by a support (not shown) and capable of rotating about an axis of the driving roller 30 by a driving mechanism (not shown). The rotation of the driving roller 30 drives the intermediate transfer belt 32 to rotate. The driving roller 30 is in pressure-contact with the transfer roller 37 with the intermediate transfer belt 32 therebetween. A pressure-contact area between the driving roller 30 and the transfer roller 37 is a transfer nip area. The driven roller 31 is a roller-like member which is rotatably supported by a support (not shown). The driven roller 31 is driven to rotate by the rotation of the intermediate transfer belt 32. The driven roller 31 gives appropriate tension to the intermediate transfer belt 32, thereby assisting the intermediate transfer belt 32 to rotate smoothly.

The intermediate transfer belt 32 is an endless belt-like member which is stretched out by the driving roller 30 and the driven roller 31, thereby forming a loop-shaped travel path, and which rotates as driven by the rotation of the driving roller 30. When the intermediate transfer belt 32 passes by the photoreceptor drum 11 in contact therewith, the transfer bias whose polarity is opposite to the polarity of the charged toner on the surface of the photoreceptor drum 11, is applied to the intermediate transfer belt 32 from the intermediate transfer roller 33 which is disposed opposite to the photoreceptor drum 11 across the intermediate transfer belt 32, with the result that the toner image formed on the surface of the photoreceptor drum 11 is transferred onto the intermediate transfer belt 32. In the case of a full-color image, the toner images of respective colors formed on the respective photoreceptor drums 11 are sequentially transferred onto the intermediate transfer belt 32 and overlaid on top of one another, whereby a full-color toner image is formed.

The intermediate transfer roller 33 is a roller-like member which is in pressure-contact with the photoreceptor drum 11 with the intermediate transfer belt 32 therebetween and which can rotate about an axis thereof with the aid of a driving mechanism (not shown). The intermediate transfer roller 33 is connected to a power source (not shown) for applying the transfer bias as described above, and thus has a function of transferring the toner image formed on the surface of the photoreceptor 11 onto the intermediate transfer belt 32. A pressure-contact area between the intermediate transfer roller 33 and the photoreceptor drum 11 is called the intermediate transfer nip area.

The transfer belt cleaning unit 34 includes transfer belt cleaning blades 35*a* and 35*b* and a second waste toner reservoir 36. The transfer belt cleaning blades 35*a* and 35*b* are platy members, each of which has one end in contact with a surface of the intermediate transfer belt 32 and the other end supported by the second waste toner reservoir 36 and which are disposed so as to face each other. The transfer belt cleaning blades 35*a* and 35*b* scrape off and collect the toner, paper dust, etc. which remain on the surface of the intermediate transfer belt 32. In the second waste toner reservoir 36, there temporarily accumulate the toner, paper dust, etc. scraped off by the transfer belt cleaning blades 35*a* and 35*b*.

The transfer roller 37 is a roller-like member which is brought by a pressure-contact section (not shown) into pressure-contact with the driving roller 30 with the intermediate transfer belt 32 therebetween and which can rotate about an axis thereof with the aid of a driving mechanism (not shown). In the transfer nip area, the toner image borne and conveyed by the intermediate transfer belt 32 is transferred onto a recording medium fed from the later-described recording medium supplying section 5. The recording medium bearing the toner image thereon is fed to the fixing section 4. In the transferring section 3, the toner image which is to be transferred from the photoreceptor drum 11 onto the intermediate transfer belt 32 in the intermediate transfer nip area, is conveyed by the rotation of the intermediate transfer belt 32 to the transfer nip area where the toner image is transferred onto the recording medium.

The fixing section 4 is a roller-like member which includes a fixing roller 41 and a pressurizing roller 42 and which is disposed downstream of the transferring section 3 as viewed in a direction where the recording medium is conveyed. The fixing roller 41 can rotate about an axis thereof by a driving mechanism (not shown), and heats the toner constituting an unfixed toner image borne on the recording medium so that the toner is fused to be fixed on the recording medium. Inside the fixing roller 41 is provided a heating portion (not shown). The heating portion heats the heating roller 41 so that a surface of the heating roller 41 has a predetermined temperature (heating temperature). For the heating portion, an infrared heater, a halogen lamp, and the like device can be used. The surface temperature of the fixing roller 41 is maintained at a temperature which is set upon designing the image forming apparatus 1. The surface temperature of the fixing roller 41 is controlled by use of the control unit 38 of the image forming apparatus 1 and a temperature detecting sensor 81 for detecting the surface temperature of the fixing roller 41, which sensor is disposed in the vicinity of the surface of the fixing roller 41. The temperature detecting sensor 81 is electrically connected to the control unit 38. A detection result of the temperature detecting sensor 81 is thus outputted to the control unit 38. The control unit 38 compares the detection result of the temperature detecting sensor 81 with the set temperature. In the case where the temperature of detection result is lower than the set temperature, the control unit sends a control signal to a power source (not shown) for applying a voltage to the heating portion which is thereby promoted to generate heat to raise the surface temperature.

The pressurizing roller 42 is disposed in pressure-contact with the fixing roller 41, and supported so as to be capable of rotating when driven by the rotation of the pressurizing roller 42. A pressure-contact area between the fixing roller 41 and the pressurizing roller 42 is called a fixing nip area. The pressurizing roller 42 helps the toner image to be fixed onto the recording medium by pressing the toner and the recording medium when the toner is fused to be fixed on the recording medium by the fixing roller 41. Inside the pressurizing roller 42, a heating portion can be disposed such as an infrared heater, a halogen lamp, or the like device. In the fixing section 4, the recording medium onto which the toner image has been transferred in the transfer section 3 is nipped by the fixing roller 41 and the pressurizing roller 42 so that when the recording medium passes through the fixing nip area, the toner image is pressed and thereby fixed on the recording medium under heat, whereby an image is formed.

The recording medium supplying section 5 includes a paper feed tray 51, pickup rollers 52 and 56, conveying rollers 53 and 57, registration rollers 54, and a manual paper feed tray 55. The paper feed tray 51 is a container-like member which is disposed in a lower part of the image forming apparatus 1 as viewed in a vertical direction and which contains the recording mediums. Examples of the recording medium include plain paper, color copy paper, sheets for over head projector, and post cards. The size of the recording medium includes A3, A4, B4, and B5. The pickup roller 52 takes out sheet by sheet the recording mediums contained in the paper feed tray 51, and feeds the recording medium to a paper conveyance path P1. The conveying rollers 53 are paired roller-like members which are provided in pressure-contact with each other and used to convey the recording medium toward the registration rollers 54. The registration rollers 54 are paired roller members which are provided in pressure-contact with each other and used to feed to the transfer nip area the recording medium fed from the conveying rollers 53 in synchronization with the conveyance of the toner image borne on the intermediate transfer belt 32 to the transfer nip area. The manual paper feed tray 55 is a device for taking the recording medium into the image forming apparatus 1 by manual performance. The pickup roller 56 is a roller-like member for feeding to a paper conveyance path P2 the recording medium taken from the manual paper feed tray 55 into the image forming apparatus 1. The paper conveyance path P2 is merged into the paper conveyance path P1 on an upstream side of the registration rollers 54 in a direction where the recording medium is conveyed. The conveying rollers 57 are paired roller members which are provided in pressure-contact with each other and used to feed the recording medium which has been taken into the paper conveyance path P2 by the pickup roller 56, to the registration rollers 54 through the paper conveyance path P1.

The discharging section 6 includes paper discharge rollers 60, a catch tray 61, and a plurality of sets of the conveying rollers 57. The paper discharge rollers 60 are paired roller-like members which are provided in pressure-contact with each other downstream of the fixing nip area in the direction where the paper is conveyed. Further, the paper discharge roller 60 can rotate back and forth by a driving mechanism (not shown). The paper discharge rollers 60 discharge the recording medium onto which the image has been formed in the fixing section 4, to the catch tray 61 disposed on an upper surface of the image forming apparatus 1 as viewed in the vertical direction. In the case where a duplex print command is inputted to the control unit 38 of the image forming apparatus 1, the recording medium discharged from the fixing section 4 is once held between the paper discharge rollers 60 which then feed the recording medium toward a paper conveyance path P3. The paper conveyance path P3 is merged into the paper conveyance path P1 on an upstream side of the registration rollers 54 in a direction where the recording medium is conveyed. The plurality of sets of the conveying rollers 57 are disposed along the paper conveyance path P3 and used to convey toward the registration rollers 54 in the paper conveyance path P1 the recording medium having one side thereof already printed, which recording medium is fed by the paper discharge rollers 60 to the paper conveyance path P3.

The image forming apparatus 1 includes the control unit 38. The control unit 38 is disposed, for example, in an upper part of the internal space of the image forming apparatus 1, and contains a memory portion 82, a computing portion 83, and a control portion 84. To the memory portion 82 of the control unit 38 are input, for example, various set values obtained by way of an operation panel (not shown) disposed on the upper surface of the image forming apparatus 1; detection results of a sensor (not shown) etc. disposed in various portions inside the image forming apparatus 1; image information obtained from an external equipment; and data tables for performing various controls. Further, programs for operating various functional elements 85 are written. Examples of the various functional elements 85 include a print speed switching section 73, a toner concentration calculating section 74, a toner supply controlling section 75, a sensitivity switching section 76, a toner concentration correcting section 77, rotation distance accumulating sections 78*a* and 78*b*, a layer decrease calculating section 79, a patch forming section 80, a detection result correcting section 86, a print coverage calculating section 88, and a process control section 89. For the memory portion 82, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 1. Examples of the external equipment include a computer, a digital camera, a television, a video recorder, a DVD recorder, an HDVD, a blu-ray disc recorder, a facsimile machine, and a mobile device. The computing portion 83 takes out the various data (such as an image formation order, the detection result, and the image information) and the programs for operating the various functional elements 85, which are written in the memory portion 82, and then makes various determinations. The control portion 84 sends to a relevant device a control signal in accordance with the result determined by the computing portion 83, thus performing controls on operations. The control portion 84 and the computing portion 83 include a processing circuit which is achieved by a microcomputer, a microprocessor, etc. having CPU (central processing unit). The control unit 38 contains a main power source as well as the above-stated processing circuit. The power source supplies electricity to not only the control unit 38 but also respective devices provided inside the image forming apparatus 1.

In the image forming apparatus 1, the toner is supplied from the toner cartridge 24 to the developer tank 20 by using, for example, the toner concentration sensor 70, the print speed detecting section 73, the toner concentration calculating section 74, and the toner supply controlling section 75. In the embodiment, the permeability detecting sensor is used as the toner concentration sensor 70. Further, in the embodiment, the reference toner concentration of the developer in the developer tank 20 is written in the memory portion 82 of the control unit 38. The reference toner concentration is set upon designing the image forming apparatus 1. In the memory portion is also written in advance a first data table which shows a correlation between the concentration of the toner in the developer tank and the detection result (an output voltage value which will be hereinafter referred to as "concentration detection result") of the toner concentration sensor 70, which detection result is obtained at monochrome image print speed that is most frequently adopted in the image forming apparatus 1. To be specific, an actual output value (unit: Volt) of the permeability detecting sensor is measured for each toner concentration, thereby obtaining a relation between the toner concentration and the actual output value of the permeability detecting sensor. The actual output value is subjected to the analog-digital conversion, thereby being represented by zero to 255 (8 bit). And then, a second data table is also written in advance. The second data table is a correction table for converting a density detection result at color image print speed to a density detection result at monochrome image print speed. Also written in advance is a third data table which is a correction table for converting a density detection result at heavy paper print speed to a density detection result at monochrome image print speed. All the first to third data tables are provided for respective colors of black (k), magenta (m), cyan (C), and yellow (y). The first to third data tables are set for each model of image forming apparatus and/or each model of toner concentration sensor.

As described above, the toner concentration sensor 70 is provided for each of the developer tanks 20*k*, 20*m*, 20*c*, and 20*y* and used to detect the concentration of the toner in the toner tank 20, then outputting to the control unit 38 the detection result in the form of the output voltage value. The output voltage value given by the toner concentration sensor 70 is written in the memory portion 82 of the control unit 38. The toner concentration detecting sensor 70 continues to perform the detections at predetermined time intervals from a time point when a print command is inputted to the control unit 38 to a time point when the image forming operation ends. Also during a start-up process of the image forming apparatus 1, the concentration of the toner in the developer tank 20 is detected by the toner concentration sensor 70.

The print speed switching section 73 reads the print speed in print information contained in the print command which is inputted by the control unit 38, then switching the print speed. The print speed includes a monochrome image print speed (high), a color image print speed (middle), and a heavy paper print speed (low). To be more specific, the print speed switching section 73 sends control signals, in accordance with a readout result of the print speed, to various portions necessary for switching the print speed, through the control portion 84 of the control unit 38, thereby controlling operation speeds (process speeds) of various portions as well as the print speed. The readout result of the print speed switching section 73 is inputted to the memory portion 82. The readout result inputted to the memory portion 82 includes at least the last readout result and this time's readout result. The last readout result but one may be deleted every time a new readout result is inputted. When a readout result is newly inputted, the readout result now becomes this time's readout result. The comparison between the last readout result and this time's readout result makes it possible to determine whether or not the print speed has changed.

The toner concentration calculating section 74 determines the concentration of the toner in the developer tank 20 on the basis of the density detection result in accordance with the print speed switched by the print speed switching section 73. In the case where the print speed is the monochrome image print speed, the density detection result and the first data table are taken out from the memory portion 82 to be then compared with each other, whereby toner concentration corresponding to the density detection result is selected in the first data table. The selected toner concentration is defined as the concentration of the toner in the developer tank 20. In the case where the print speed is the color image print speed, the following process is carried out. Firstly, the density detection result and the second data table are taken out from the memory portion 82 to thereby obtain a corrected density detection result from the second data table, which corrected density detection result is then written in the memory portion 82. Next, the corrected density detection result and the first data table are taken out to be then compared with each other, whereby toner concentration corresponding to the corrected density detection result is selected in the first data table. The selected toner concentration is defined as the concentration of the toner in the developer tank 20. In the case where the print speed is the heavy paper print speed, the concentration of the toner in the developer tank 20 is determined in a process which is the same as the above process for the color image print speed except that the third data table is used instead of the second data table. The result determined by the toner concentration calculating section 73 is inputted to the memory portion 82.

In accordance with the result determined by the toner concentration calculating section 74 (which result will be hereinafter referred to "concentration calculation result"), a toner supply controlling section 75 controls the toner supply to the developer tank 20. Firstly, the concentration calculation result and the reference toner concentration of the developer in the developer tank 20 are taken out from the memory portion 82 to be then compared with each other. In the case where the concentration calculation result is lower than the reference toner concentration, a difference between the reference toner concentration and the concentration calculation result is computed; on the basis of the difference thus determined, a toner supply amount is computed; and on the basis of the toner supply amount thus determined, the number of rotations of the toner cartridge 24 is determined. In the case where the toner supply amount includes a fractional amount that is less than the toner amount discharged by one rotation of the toner cartridge 24, the fractional amount is counted as one rotation. In accordance with the computation result obtained as above, the toner supply controlling section 75 sends a control signal to a driving mechanism (not shown) for rotating the toner cartridge 24 and also to a power supply (not shown) for supplying the drive electric power, thereby rotating the toner cartridge 24 the determined number of times. As a result, almost an appropriate amount of the toner is supplied to the developer tank 20. In the case where the toner supply amount is only the fractional amount less than the toner amount discharged by one rotation of the toner cartridge 24, the toner supply may be suspended to control the toner concentration sensor to accelerate the detection of toner concentration.

In the embodiment, the concentration detection result of the toner concentration sensor 70 can be corrected by a detection result correcting section 86. As a result, more accurate concentration of the toner in the developer tank 20 can be obtained and on the basis of the concentration, a more appropriate amount of the toner can be supplied to the developer tank 20.

The detection result correcting section 86 corrects a control voltage Vc of the toner concentration sensor in accordance with various correction parameters, for example, to thereby obtain an output voltage Vout which is constant regardless of the process speed. At this time, to the memory portion 82 is inputted a data table which shows a relation between the process speed and the correction amount of Vc for each correction parameter. On the basis of the data table, the detection result correcting section 86 corrects the control voltage Vc which is inputted to the toner concentration sensor. The correction parameter is not particularly limited as long as it influences the concentration of the toner in the developer tank 20. The correction parameter includes, for example, a temperature inside the image forming apparatus 1, humidity inside the image forming apparatus 1, a temporal change represented by a decreasing amount of the photosensitive layer on the surface of the photoreceptor drum 11, and a correction value determined by a process control.

The detection result correcting section 86 uses as one of the correction parameters the temporal change in the decreasing amount of the photosensitive layer on the surface of the photoreceptor drum 11, and corrects the toner concentration according to the temporal change. The decreasing amount of the photosensitive layer on the surface of the photoreceptor drum 11 is obtained by using, for example, the rotation distance accumulating sections 78*a* and 78*b* for the photoreceptor drum 11 or the developing roller 21, or the layer decrease calculating section 79 for the photoreceptor drum 11.

The rotation distance accumulating section 78*a* for the developing roller 21 accumulates a total rotation distance (unit: cm) of the developing roller 21 by counting up rotation distances thereof from a time when the developing roller 21 is brought into service (i.e., a time point when the developing roller 21 is brand-new) to the present time. The obtained total rotation distance will be hereinafter referred to simply as "total rotation distance of the developing roller 21". The rotation distance accumulating section 78*a* determines the total rotation distance of the developing roller 21, for example, in a manner that the total number of rotations of the developing roller 21 and a travel distance (unit: cm) for each rotation of the developing roller 21 are taken out from the memory portion 82 and accumulated. The calculation result obtained by the rotation distance accumulating section 78*a* is written in the memory portion 82. The total number of rotations of the developing roller 21 is detected, for example, by a counter 87*a* serving as a measuring section, which counter 87*a* is disposed inside the control unit 38 and detects the number of rotations of the developing roller 21. The detection result obtained by the counter 87*a* is written in the memory portion 82. Moreover, the travel distance (unit: cm) of the developing roller 21 for each rotation thereof is written in the memory portion 82 in advance.

The rotation distance accumulating section 78*b* for the photoreceptor drum 11 has the same configuration as that of the rotation distance accumulating section 78*a* for the developing roller 21. That is to say, the rotation distance accumulating section 78*b* for the photoreceptor drum 11 accumulates a total rotation distance (unit: cm) of the photoreceptor drum 11 by counting up rotation distances thereof from a time when the photoreceptor drum 11 is brought into service (i.e., a time point when the photoreceptor drum 11 is brand-new) to the present time. The obtained total rotation distance will be hereinafter referred to simply as "total rotation distance of the photoreceptor drum 11". The rotation distance accumulating section 78*b* determines the total rotation distance of the photoreceptor drum 11, for example, in a manner that the total number of rotations of the photoreceptor drum 11 and a travel distance (unit: cm) for each rotation of the photoreceptor drum 11 are taken out from the memory portion 82 and accumulated. The calculation result obtained by the rotation distance accumulating section 78*b* is written in the memory portion 82. The total number of rotations of the photoreceptor drum 11 is detected, for example, by a counter 87*b* serving as a measuring section, which counter 8*b* is disposed inside the control unit 38 and detects the number of rotations of the photoreceptor drum 11. The detection result obtained by the counter 87*b* is written in the memory portion 82. Moreover, the travel distance (unit: cm) of the photoreceptor drum 11 for each rotation thereof is written in the memory portion 82 in advance.

The layer decrease calculating section 79 calculates the decreasing amount of the photosensitive layer in accordance with the calculation result of the rotation distance accumulating sections 78*a* and 78*b* for the developing roller 21 or the photoreceptor drum 11. In the memory portion 82, a fourth data table or a fifth data table is written in advance. The fourth data table shows a relation between the total rotation distance of the developing roller 21 (which distance is a travel distance of the developer and represented by the centimeter) and the decreasing amount of the photosensitive layer. The fifth data table shows a relation between the total rotation distance (unit: cm) of the photoreceptor drum 11 and the decreasing amount of the photosensitive layer. The layer decrease calculating section 79 takes out the fourth data table and the total rotation distance of the developing roller 21 from the memory portion 82 and determines the decreasing amount of the photosensitive layer by the total rotation distance based on the fourth data table. Further, the layer decrease calculating section 79 takes out the fifth data table and the total rotation distance of the photoreceptor drum 11 from the memory portion 82, and determines the decreasing amount of the photosensitive layer by the total rotation distance based on the fifth data table. The calculation result obtained by the layer decrease calculating section 79 is inputted to the memory portion 82.

Further, in the memory portion 82 is written a sixth data table in advance. The sixth data table shows a relation between the decreasing amount of the photosensitive layer and the correction value for the value of control voltage which is applied to the toner concentration sensor 70. The sixth data table is set for each model of the image forming apparatus and/or each model of the toner concentration sensor 70. Note that the decreasing amount of the photosensitive layer is in direct proportion to the total rotation distance (unit: cm) of the developing roller 21, and the sixth data table may be therefore replaced by a data table which shows a relation between the total rotation distance (unit: cm) of the developing roller 21 and a correction amount for the detection sensitivity of the toner concentration sensor 70 (i.e., the correction value for the control voltage). In the embodiment, the data table shown in Table 1 is used as the sixth data table. The control is carried out by adding the correction value for control voltage stated in the sixth data table to the value of the control voltage.

Further, in the memory portion 82 is written a seventh data table in advance. The seventh data table shows a relation between the total rotation distance and the correction value for the value of voltage outputted from the toner concentration sensor 70 at monochrome image print speed. In this case, the value of control voltage applied to the toner concentration sensor 70 is the value of control voltage which is obtained by correcting the reference value of control voltage based on the sixth data table. Note that, also for the relation between the total rotation distance and the correction value for the value of voltage outputted from the toner concentration sensor 70 at each of color image print speed and heavy paper print speed, a data table may be inputted which data table is obtained in advance through an experiment, etc. Alternatively, the output voltage value corrected based on the sixth data table may be corrected according to the print speed so as to be used for the case at color image print speed or heavy paper print speed by using a first proportional constant $k_1$ for correlation between the above relation at monochrome image print speed and the above relation at color image print speed while using a second proportional constant $k_2$ for correlation between the above relation at monochrome image print speed and the above relation at heavy paper print speed because the above relation at monochrome image print speed is almost in proportion to the above relation at each of color image print speed and heavy paper print speed. It is thus not necessary to acquire the data for all values of total rotation distances at color image print speed and heavy paper print speed, but is necessary to acquire only the data for any given value of total rotation distance selected for data acquisition. As a result, not only almost a precise correction value can be obtained but also the setting for each model of the image forming apparatus is simplified.

Further, the toner concentration correcting section 77 uses the process control as one of the correction parameters, and corrects the toner concentration according to the process control. The correction is carried out with use of the patch forming section 80 and the patch density detecting section 72, for example. The patch forming section 80 controls the image forming section 2 and thereby forms on the surface of the photoreceptor drum 11 a toner patch which is a toner image for detecting the toner concentration. The toner patch is, for example, composed of eight squares, each of which square measures about 8 cm on each side. The patch forming section 80 modifies forming conditions and thereby forms a plurality of toner patches which are sequentially different in the toner concentration, i.e., the patch density. Preferably, a plurality of toner patches is formed so as to correspond to the print density which can be set in the image forming apparatus 1. The forming condition herein includes a value of development bias voltage to be applied to the developing roller 21, a value of voltage for charging (charge potential) to be applied to the surface of the photoreceptor drum 11, and a value of voltage for the exposure unit 16 to charge an electrostatic latent image formed on the surface of the photoreceptor drum 11 (exposure potential). Among these parameters of the forming condition, one or two or more parameters are fixed at certain levels while the remaining parameters are appropriately modified by certain amounts, whereby the plurality of toner patches sequentially different in the patch density are formed. For example, the plurality of toner patches may be formed at the fixed charge potential and exposure potential with changing development bias voltage of which value is modified by a certain amount. The forming condition (such as the value of development bias voltage) for the plurality of toner patches is written in the memory portion 82.

The patch density detecting section 72 detects the patch density of the toner patch formed on the surface of the photoreceptor drum 11. The detection result of the patch density detecting section 72 (which result will be hereinafter referred to as "patch density detection result") is written in the memory portion 82. In the memory portion 82, written in advance is reference patch density which is set upon designing the image forming apparatus 1. The written reference patch density is, for example, a reference amount of reflected light for monochrome images and a reference amount of scattered light for color images. After the patch density is detected by the patch density detecting section 72, the toner patch is removed by the cleaning unit 14 from the surface of the photoreceptor drum 11. The patch density detection result and the reference patch density are taken out from the memory portion 82 and compared with each other by the toner concentration correcting section 77. The control unit then reads out a value of development bias voltage used for forming a toner patch whose patch density is the closet to the reference patch density, and thereby obtains a difference between the above value of development bias voltage and a value of development bias voltage for the reference patch density, which difference is then written in the memory portion 82 as a correction amount for development bias. The print coverage calculating section 88 determines a print coverage in printing the recording medium. The process control section 89 adjusts the image density and the developing condition according to the density of the toner patch.

An operation of the detection result correcting section 86 will be hereinbelow described in detail.

First of all, a toner supply operation will be described.

Figure 3:
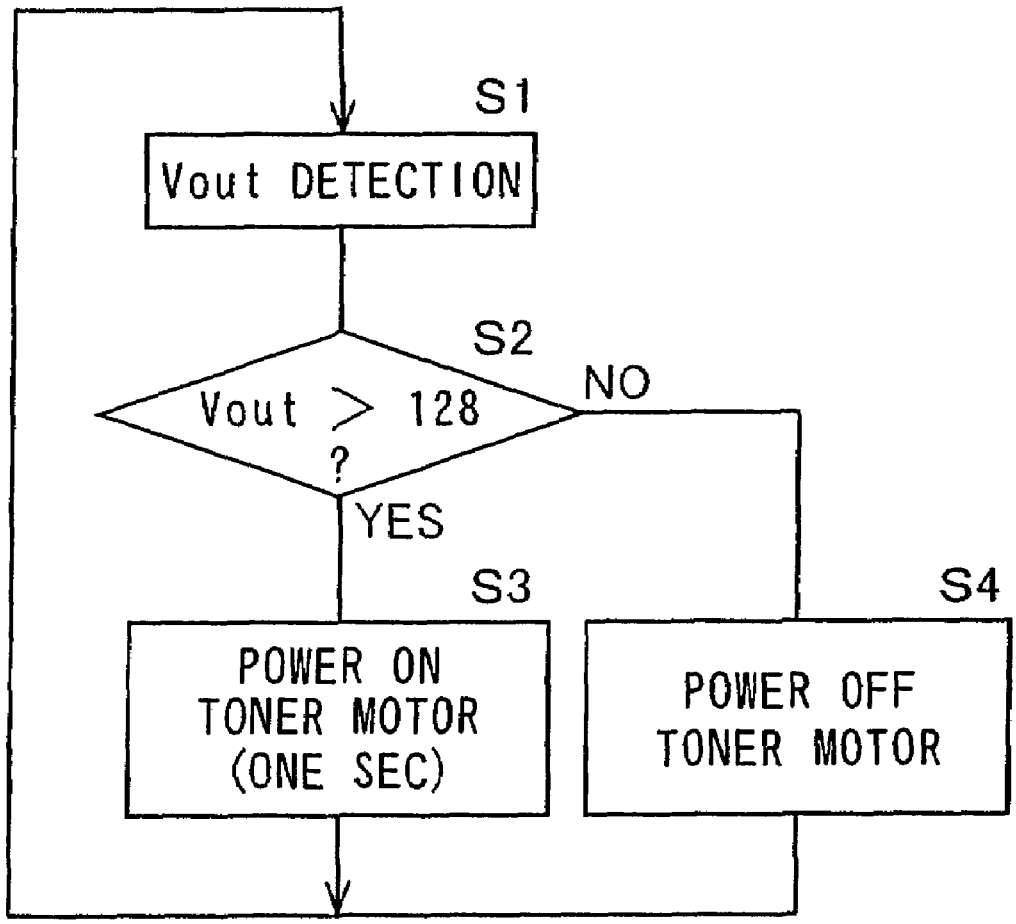
FIG. 3 is a flowchart illustrating a toner supply operation of the invention.

FIG. 3 is a flowchart illustrating the toner supply operation of the invention. A process shown in the flowchart is repeated every 500 milliseconds. At Step S1, the output voltage Vout of the toner concentration sensor is detected after a 1.5-sec agitation in the developer tank. At Step S2, a determination is made as to whether or not the detected output voltage Vout represented by an 8-bit value is larger than 128. When the detected output voltage Vout is larger than 128, the process proceeds to Step S3 where the toner motor is made to rotate for one second to supply 200 mg toner (equivalent to 0.022% in the toner concentration) into a supply developer tank. When the detected output voltage Vout is 128 or less, the process proceeds to Step S4 where the toner motor is made to stop rotating.

Figure 4:
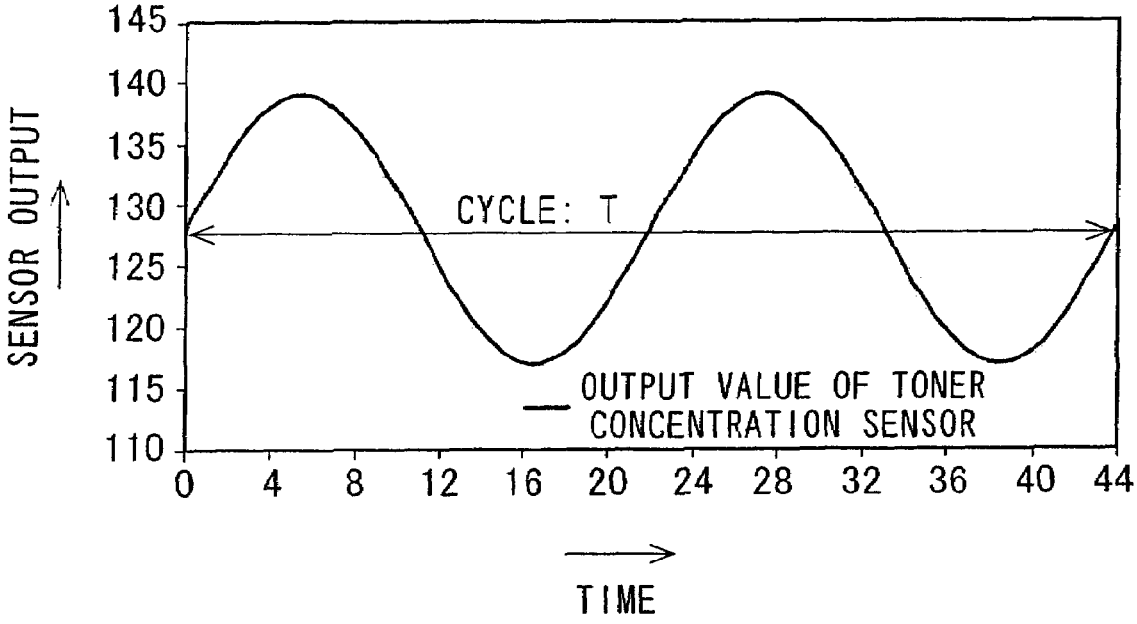
FIG. 4 is a graph showing a temporal change of an output voltage level Vout of a toner concentration sensor.

The output voltage Vout of the toner concentration sensor forms a sine wave as shown in FIG. 4. This is attributable to variation in the concentration of the developer, which arises during one cycle T of an agitating member, i.e., a mixing roller. Since the mixing roller (which is also referred to as "MX roller") has symmetrical oval blades for agitation, a detected value of toner concentration forms two cycle-sine wave during one rotation of the mixing roller. Table 1 shows a rotation cycle of the mixing roller for each process speed. Data for one cycle of the mixing roller is acquired at high and middle process speeds while data for half a cycle of the mixing roller is acquired at low process speed.

The permeability detecting sensor detects data every 10 milliseconds. As a result, the number of acquired data is 24, 41, and 29, respectively for high, middle, and low process speeds, and an average value thereof is detected as a value of toner concentration.

TABLE 1

| | Process speed (mm/sec) | Number of MX rotations (rpm) | Cycles of MX rotations (ms) | Number of data acquired | Detection time (ms) |
|---|---|---|---|---|---|
| High | 300 | 250.7 | 239.3 | 24 | 240 |
| Middle | 173 | 144.6 | 414.9 | 41 | 410 |
| Low | 124 | 103.6 | 579.2 | 29 | 290 |

A developer concentration adjustment value will be then described which serves as a basic value of control voltage Vc.

In the initial stage, the developer tank contains 900 g of the developer which corresponds to 5% toner concentration. When new developer is fed upon a toner supply, a developer concentration adjustment is carried out. The developer concentration adjustment indicates a process such that the developer in the developer tank is agitated for two minutes and 15 seconds and then, toner concentration is measured by the toner concentration sensor 70 for 15 seconds at each of the low, middle, and high process speeds, whereby the developer concentration adjustment value is detected.

Table 2 shows one example of the developer concentration adjustment value. This shows the control voltage Vc (V) or its 8-bit converted value Vc, automatically measured by the toner concentration sensor, which is necessary for 2.5 V in output voltage Vout (equivalent to 128 in 8-bit converted value) at each of the low, middle, and high process speeds upon using in advance the developer having predetermined concentration.

TABLE 2

| | Vc (V) | Vc (8-bit value) | Vout (V) |
|---|---|---|---|
| Low | 4.5 | 115 | 2.5 |
| Middle | 5 | 128 | 2.5 |
| High | 5.5 | 141 | 2.5 |

The other corrections acting as the parameters include a temperature correction, a humidity correction, a temporal correction, a print coverage correction, and a process control correction. When the charge amount of the toner becomes larger, a particle-to-particle distance in the toner becomes longer, resulting in a decrease in the value detected by the permeability detecting sensor. In this case, the correction is therefore carried out to increase Vc. In contrast, when the charge amount of the toner becomes smaller, the correction is carried out to decrease Vc. In order to determine how much Vc is to be corrected for changes in environment, temporal changes, and changes in print coverage, the correction table as above is used to correct Vc.

The changes in print coverages is detected by calculating an average of print coverage based on 30 sheets of A4-sized paper printed. That is to say, there are 30 data boxes, and for every one printing process, the oldest data is deleted while new data of print coverage is inputted to calculate an average value of all the data and thus obtain a corresponding correction value for Vc.

Further, in the process control correction, patch density is detected, and according to a level of the detected density, development voltage is determined and at the same time, the correction value for Vc corresponding to the detected density is also determined.

As described above, a developer concentration correction value serving as a basic value is determined through the adjustment of developer concentration; the correction values for the other correction parameters are obtained for each of the process speeds; and a sum of Vc correction is calculated. Table 3 shows one example of the correction values.

TABLE 3

| | Process speed | | |
|---|---|---|---|
| | Low | Middle | High |
| Developer concentration correction value | 115 | 128 | 141 |
| Temperature correction value | −5 | −5 | −5 |
| Humidity correction value | −3 | −3 | −3 |
| Temporal correction value | 15 | 15 | 15 |
| Print coverage correction value | −2 | −2 | −2 |
| Process control correction value | 10 | 10 | 10 |
| Sum of Vc correction | 130 | 143 | 156 |

The process control is performed when the apparatus is started up and when no developing operation is carried out after the predetermined number of sheets have been printed. After the process control is performed, the sum of Vc correction Vc determined in Table 3, for example, is inputted to the toner concentration sensor as the control voltage value Vc, and an output voltage value Vout is detected for each of the process speeds.

On the basis of the detected output value values Vout for respective process speeds, a difference is obtained between the output voltage value Vout at high process speed and the output voltage value Vout at middle process speed while a difference is obtained between the output voltage value Vout at low process speed and the output voltage value Vout at middle process speed. The differences thus obtained are defined as difference correction values. On the basis of the difference correction values and other correction values, a speed correction coefficient (unit: %) is determined as follows:

Speed correction coefficient (%)=(Other correction values−Difference correction value)/(Other correction values)×100

Lastly, a final Vc correction value for toner supply is determined. The final Vc correction value is determined by the following calculation using the determined speed correction coefficient:

(Developer concentration correction value)+(Other correction values)×(Speed correction coefficient)

Table 4 shows one example of results obtained by the above calculation.

TABLE 4

| | Process speed | | |
|---|---|---|---|
| | Low | Middle | High |
| Developer concentration correction value | 115 | 128 | 141 |
| Other correction values | 15 | 15 | 15 |
| Sum of Vc correction | 130 | 143 | 156 |
| Detected Vout value (8-bit value) | 127 | 135 | 142 |
| Difference correction value | −8 | 0 | 7 |
| Speed correction coefficient | 153% | 100% | 53% |
| Final Vc correction value (Value of control voltage) | 137.95 | 143 | 148.95 |
| Final Vout correction value (8-bit value) | 135 | 135 | 135 |

More specific descriptions will be given on Table 4. In the case where the sums of Vc correction (130, 143, 156) are inputted for respective process speeds, the difference correction value is −8 points at low process speed and 7 points at high process speed when the detected Vout value 135 (represented by 8-bit value) is used as a reference. Accordingly, a correction amount of other correction values (which is 15 in the present example) is modified so that the detected Vout values (represented by 8-bit value) at respective process speeds are equal to each other, that is, 135. To be specific, the correction is carried out so that the final Vc correction value (value of control voltage) is 137.95 at low process speed and 148.95 at high process speed.

As can be seen, the sum of Vc correction and the final Vc correction value are obviously different from each other and therefore, the control voltage is not sufficiently corrected if only the predetermined correction values for respective correction parameters are used. In the invention, the output voltage Vout is detected first and a result thus detected is then used to determine a correction value, which process allows for more accurate correction of output values.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image forming section for forming an image by printing a toner image on a recording medium, the image forming section including a photoreceptor having a photosensitive layer for forming an electrostatic latent image, and a developing device having a developing roller for forming a toner image by supplying a toner to the electrostatic latent image on the surface of the photoreceptor and a developer tank for storing two-component developer containing a toner;

a print speed switching section for switching image printing speeds of the image forming section;

a toner concentration detecting section for detecting a concentration of the toner in the developer tank and outputting a detection result, an output value of the detection result being modified according to a control value inputted to the toner concentration detecting section;

a memory portion for storing a correction value for the control value, which correction value is determined by an association between image printing speed and another predetermined correction parameter;

a correcting section for correcting the control value based on image printing speed and another predetermined correction parameter;

a toner concentration calculating section for calculating the concentration of the toner in the developer tank based on the detection result outputted by the toner concentration detecting section; and a detection result correcting section for, during a no-image forming period, retrieving for each image printing speed a detection result outputted by the toner concentration detecting section to which the corrected control value has been inputted, and modifying the corrected control value according to the detection result retrieved.

2. The image forming apparatus of claim 1, wherein the no-image forming period is a period of start-up of the apparatus or a period after images have been formed on a predetermined number of sheets.

3. The image forming apparatus of claim 1, wherein the developing device stores two-component developer containing a color toner.

4. The image forming apparatus of claim 1, wherein the detection result correcting section determines a reference print speed; obtains a difference between a detection result at the reference print speed and a detection result at a print speed other than the reference print speed; and modifies the corrected control value according to a value of the difference obtained.

5. The image forming apparatus of claim 1, further comprising a temperature detecting section for detecting a temperature of an environment in the apparatus, wherein the memory portion stores, as another correction parameter, the temperature detected by the temperature detecting section, and a correction value determined according to the temperature.

6. The image forming apparatus of claim 1, further comprising a humidity detecting section for detecting humidity of an environment in the apparatus, wherein the memory portion stores, as another correction parameter, the humidity detected by the humidity detecting section, and a correction value determined according to the humidity.

7. The image forming apparatus of claim 1, further comprising a measuring section for measuring a temporal change of the two-component developer, wherein the memory portion stores, as another correction parameter, a measurement value and a correction value determined according to the measurement value.

8. The image forming apparatus of claim 1, further comprising a print coverage calculating section for calculating a print coverage of an image printed on a recording medium, wherein the memory portion stores, as another correction parameter, the print coverage, and a correction value determined according to the print coverage.

9. The image forming apparatus of claim 1, further comprising a process control section for adjusting image density and a developing condition according to density of a toner patch, wherein the memory portion stores, as another correction parameter, the density of the toner patch, and a correction value determined according to the density of the toner patch.

10. The image forming apparatus of claim 9, wherein the detection result correcting section modifies the corrected control value during operation of the process control section.

* * * * *